US006116968A

United States Patent [19]

Jaklin et al.

[11] Patent Number: 6,116,968

[45] Date of Patent: Sep. 12, 2000

[54] ELECTRICAL CONNECTOR WITH A CONTACT LOCKING ELEMENT

[75] Inventors: Ralf Jaklin, Liederbach; Andreas Machill, Idstein, both of Germany

[73] Assignee: The Whitaker Corporation, Wilmington, Del.

[21] Appl. No.: 09/317,066

[22] Filed: May 12, 1999

[30] Foreign Application Priority Data

May 29, 1998 [EP] European Pat. Off. ..... 98109924

[51] Int. Cl.[7] ..... H01R 13/514

[52] U.S. Cl. ..... 439/752; 439/595

[58] Field of Search ..... 439/752, 731, 439/595

[56] References Cited

U.S. PATENT DOCUMENTS 5,830,013 11/1998 Saito et al. ..... 439/595

FOREIGN PATENT DOCUMENTS 36 09 684 A1 9/1986 Germany ..... H01R 13/514

37 05 739 C2 8/1987 Germany ..... H01R 13/436

*Primary Examiner*—Renee Luebke
*Assistant Examiner*—Antoine Ngandjui

[57] ABSTRACT

An electrical connector with a housing and with a contact locking element is specified, the housing being of substantially cuboid-shaped design with a front face, a cable-side end face and four side walls, and the housing having at least two chambers for each receiving one electrical contact and that extend from the front face to the cable-side end face, the housing having an opening through a first side wall, that runs perpendicular to the chambers between the chambers and into that the contact locking element can be pushed in order to lock the electrical contacts in the chambers, the contact locking element having at least two opposite wall parts that reduce the clear width of the chambers when the contact locking element is inserted, the contact locking element having a recess between the two wall parts, and the two wall parts being connected to one another by way of a guide rib, in such a way that the wall parts are designed to be flexible towards the recess and rigid perpendicular thereto, in the direction of insertion.

8 Claims, 5 Drawing Sheets

ELECTRICAL CONNECTOR WITH A CONTACT LOCKING ELEMENT

BACKGROUND OF THE INVENTION

1. Field of the Invention

The invention relates to an electrical connector with a housing having at least one chamber for receiving an electrical contact and with a contact locking element for locking the electrical contact in the chamber.

2. Description of the Prior Art

DE 37 05 739-C2 discloses an electrical connector with a housing and with a contact locking element. The housing is of substantially cuboid-shaped design with a front face, a cable-side end face and four side walls. It has a plurality of chambers which are arranged in two rows and which are each intended for receiving an electrical contact. Further, the housing comprises an opening running perpendicular to the chambers. The contact locking element can be pushed into the opening to lock the electrical contacts in the chambers. The contact locking element has a wall part which, when inserted, reduces the clear width of the chambers when the contact, thereby preventing the contact from being removed.

DE 36 09 684-A1 likewise discloses an electrical connector with a housing and a contact locking element. The housing, which consists of a frame unit and individual modules, includes at least two chambers for each receiving one electrical contact. The housing has an opening which runs perpendicular to the chambers and between the chambers where the contact locking element can be pushed through a first side wall to lock the electrical contacts in the chambers. The contact locking element has at least two opposite wall parts which reduce the clear width of the respective chambers when the contact locking element is inserted.

The term "electrical connector" as used in the present description refers to a housing which contains a plurality of electrical contacts and serves for coupling or connection to a complementary connector in order to form a connector assembly. Housing arrangements of this type are being used in electrical cable harnesses and are employed, for example, in automotive engineering. Typically, a contact locking element is used to secure contacts in respective chambers of the housing. Assembly is accomplished by the contacts being inserted into the chambers and then the contact locking element is inserted. In this procedure, it is important to ensure that when the contact locking element is being inserted into the housing, if it abuts against a contact which is only partly inserted, the contact locking element does not push the contact away, but rather that the contact locking element cannot be introduced further. This can be effected with increasing reliability, when the area of overlap of the contact locking element and the contact is greater. This is the case when the width of the contact locking element with the opposite wall parts is maximized. Nevertheless, it must be ensured that the contact locking element can be easily inserted into the opening in the housing.

SUMMARY OF THE INVENTION

It is an object of this invention to provide an electrical connector having a housing and a contact locking element, where it is ensured that the contact locking element can be easily inserted into the housing and crushing of the contacts during the insertion of the contact locking element is avoided.

The object is achieved by an electrical connector having a housing and a contact locking element, the housing having a front face, a cable-side end face, side walls, and at least two chambers for receiving one electrical contact each where the chambers extend from the front face to the cable-side end face, the housing further having an opening through a first ide wall that runs perpendicular to and in communication with the chambers, where the contact locking element can be received to lock the electrical contacts in the chambers, the contact locking element having at least two opposite wall parts that reduce the clear width of the neighbouring chambers when the contact locking element is inserted, wherein the contact locking element has a recess between the two wall parts, and the two wall parts are connected to one another by way of a guide rib, in such a way that the wall parts are designed to be flexible towards the recess and rigid perpendicular thereto, in the direction of insertion.

The object is achieved according to the invention by the contact locking element having a recess between the two wall parts, so that the two wall parts are flexible in a direction transverse to the direction of insertion of the contact locking element in the housing. This flexibility ensures that the contact locking element can be easily introduced into an opening in a housing. In the direction of insertion, the contact locking element with the two wall parts is still of very rigid design in order to ensure a secure locking of the contacts in the chambers.

A suitable contact locking element is of substantially U- or V-shaped design in cross-section, the legs being formed by the wall parts and the base being formed by a guide rib. A guide groove which is complementary to the guide rib is part of the opening in the housing. Such a form of the contact locking element is particularly advantageous since the rigidity in the direction of insertion is thereby ensured, but the wall parts are nevertheless flexible perpendicular to the direction of insertion. It thus becomes possible to utilise optimally the space available perpendicular to the direction of insertion for the contact locking element.

It is further of particular advantage that the introduction of the contact locking element into the orresponding opening can be easily carried out. This is achieved by providing a free lead-in end of the contact locking element with a region that tapers towards the free end, thereby facilitating insertion. The tapering region protrudes with respect to the wall parts and is joined to the guide rib.

It is further of particular advantage that the contact locking element is prevented from being pushed in too far. This is accomplished by the guide rib having a region protruding, with respect to the wall parts at the lead-in end, that engages in a positive-locking manner a second side wall of the housing that is opposite the first side wall. This positive locking prevents the contact locking element from being introduced too far.

It is further of particular advantage that the contact locking element is latched in the housing in an end or fully inserted position. This is achieved by suitable latching tabs being provided on the contact locking element and complementary latching openings being provided on the housing.

It is further of particular advantage that the contact locking element is particularly easy to handle. This is achieved by the fact that the contact locking element comprises a free lead-in end and, at the opposite end, an actuating element. This actuating element may be, for example, a grip which is designed perpendicular to the direction of insertion of the contact locking element and may also connect a plurality of contact locking elements to one another.

DETAILED DESCRIPTION OF THE PREFERRED EMBODIMENT

Figure 1:
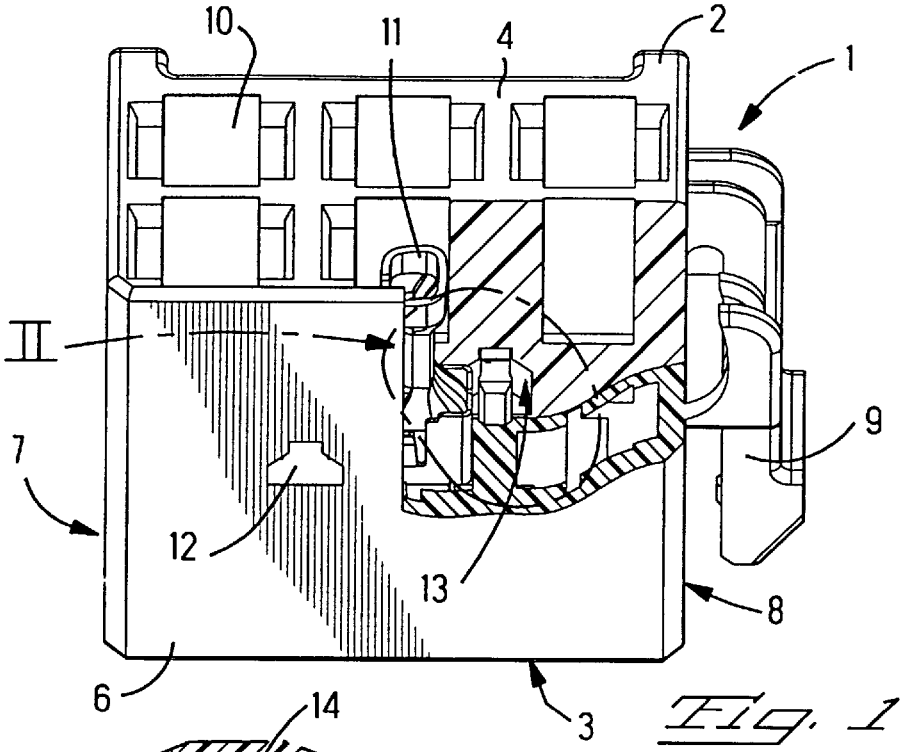
FIG. 1 shows a partially sectioned perspective view of a housing of an electrical connector according to the present invention having a contact locking element partially inserted and with an electrical contact also partially inserted.
Figure 2:
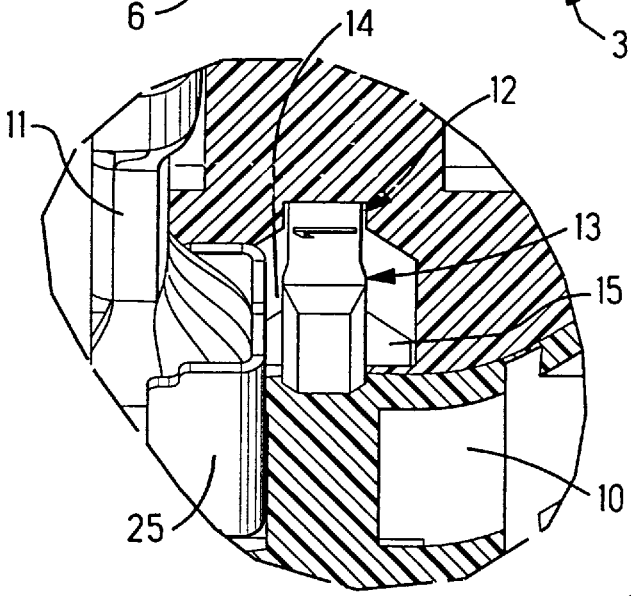
FIG. 2 shows a detail enlargement of portion II of FIG. 1.
Figure 3:
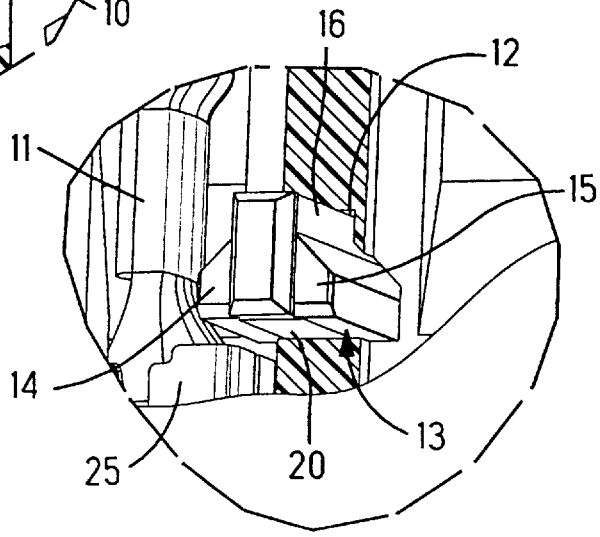
FIG. 3 likewise shows a detail view corresponding to FIG. 2 but from a different perspective.
Figure 5:
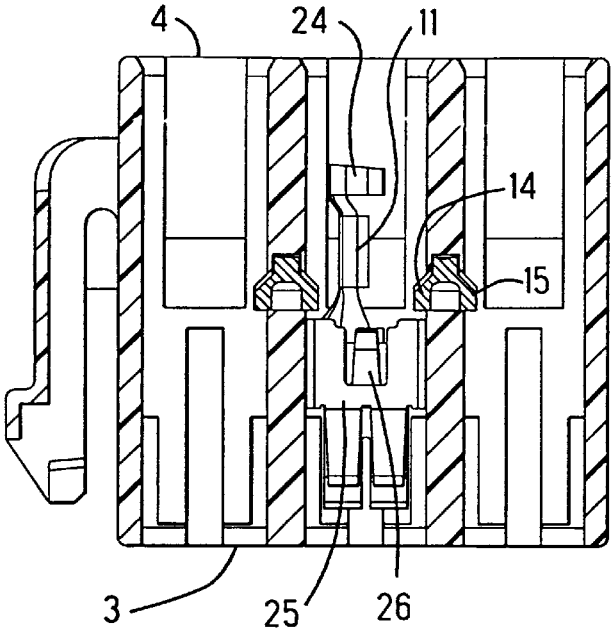
FIG. 5 shows a cross-section of the electrical connector of FIG. 4 through a row of contact chambers taken parallel to a side wall of the housing and perpendicular to the contact locking elements, with an inserted contact therein.
Figure 6:
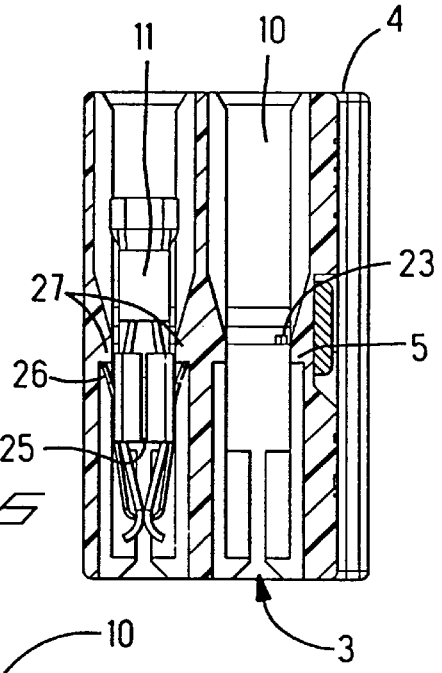
FIG. 6 shows another sectional view of the electrical connector of FIG. 4, perpendicular to the section according to FIG. 5.
Figure 4:
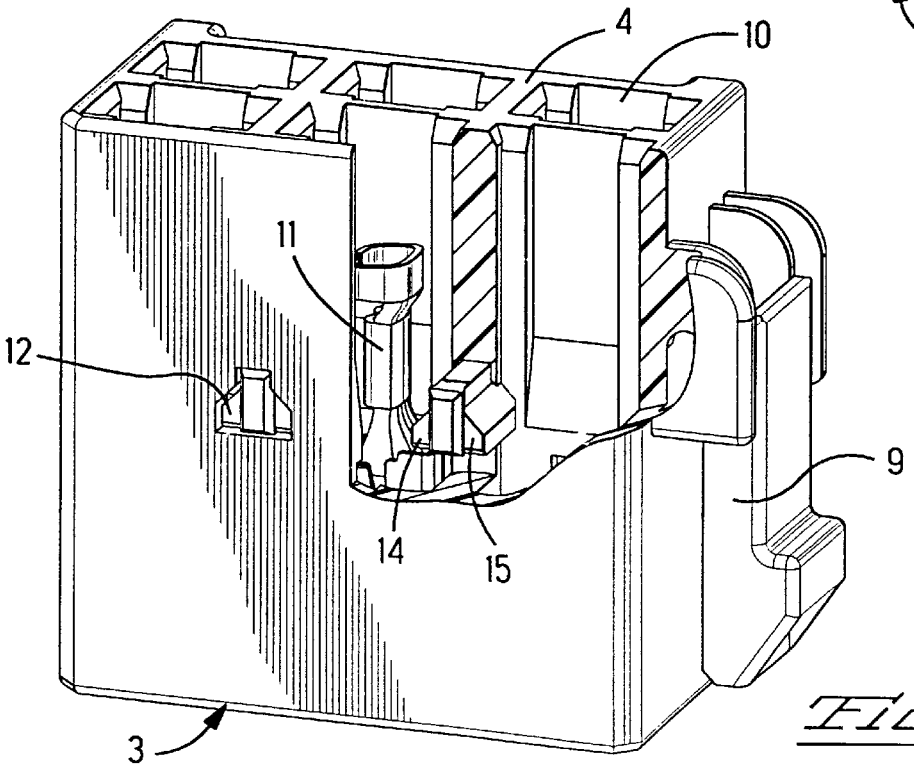
FIG. 4 shows a further partially sectioned perspective view of the electrical connector of FIG. 1 with the contact fully inserted and also the contact locking elements being fully inserted.
Figure 11:
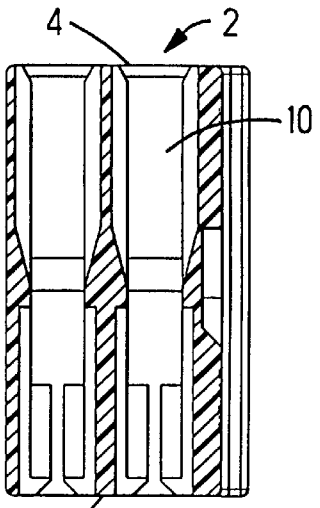
FIG. 11 is a cross-section through the housing taken along the line XI—XI of FIG. 8.
Figure 7:
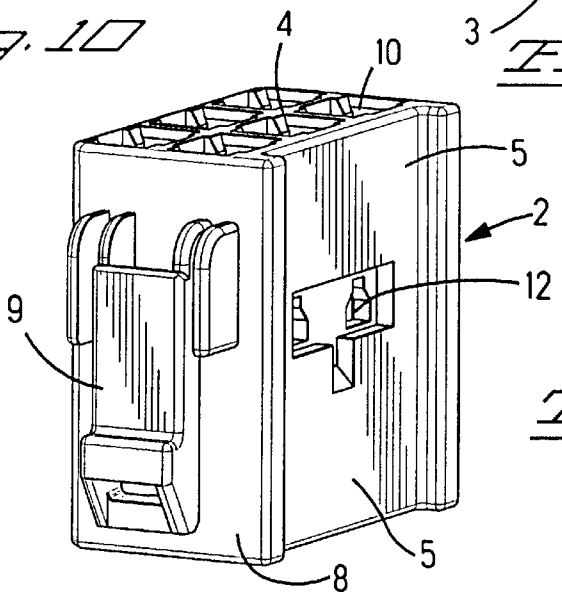
FIG. 7 shows another perspective view of the housing of the electrical connector of FIG. 1 taken from the opposite side.
Figure 10:
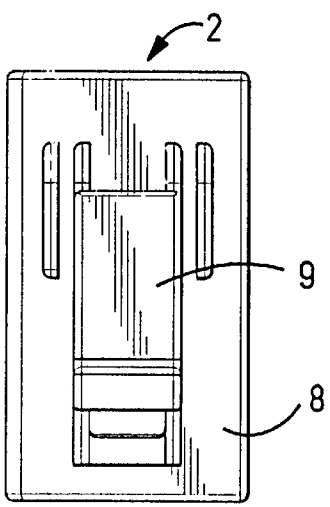
FIG. 10 is a side view of the narrow side of the housing of FIG. 7 showing the contact locking element.
Figure 8:
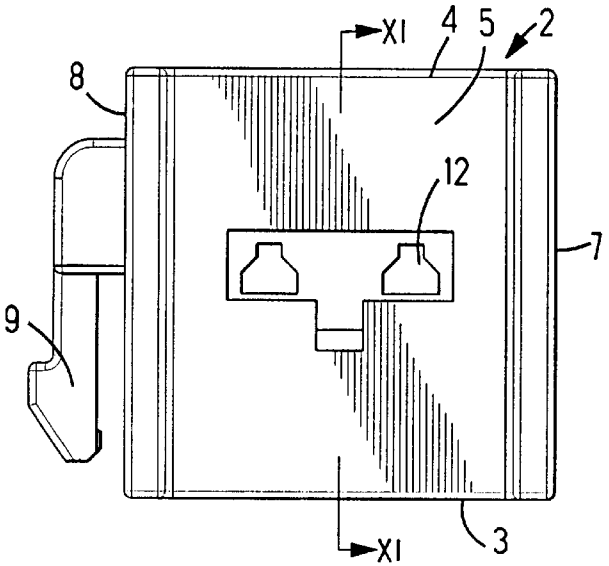
FIG. 8 shows a side view of the housing of the electrical connector of FIG. 7.
Figure 9:
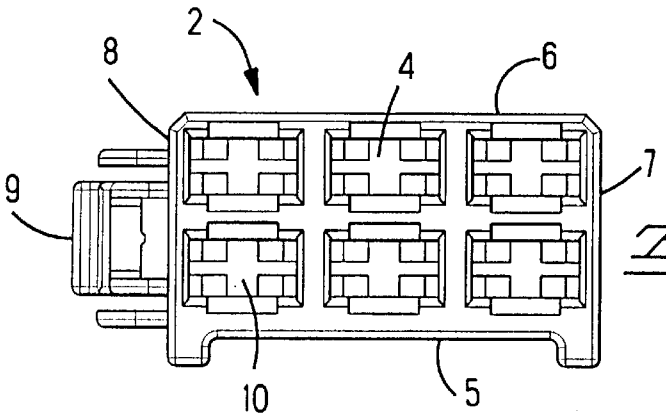
FIG. 9 is a view of the cable-side end face of the housing of the electrical connector of FIG. 7.
Figure 12:
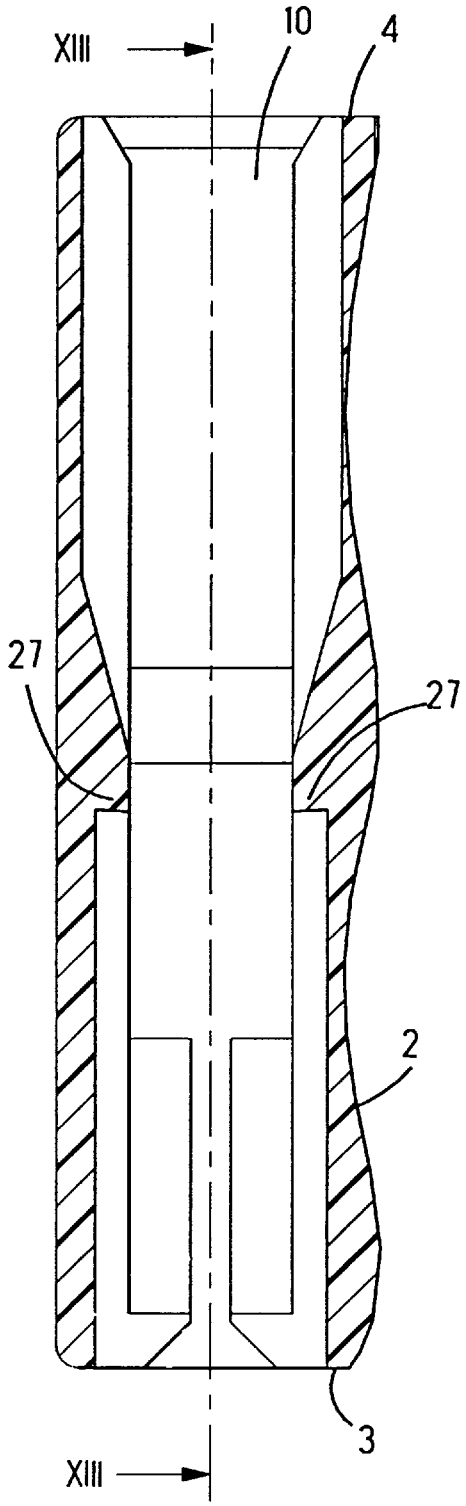
FIG. 12 is a detail enlargement of a contact chamber from FIG. 11.
Figure 13:
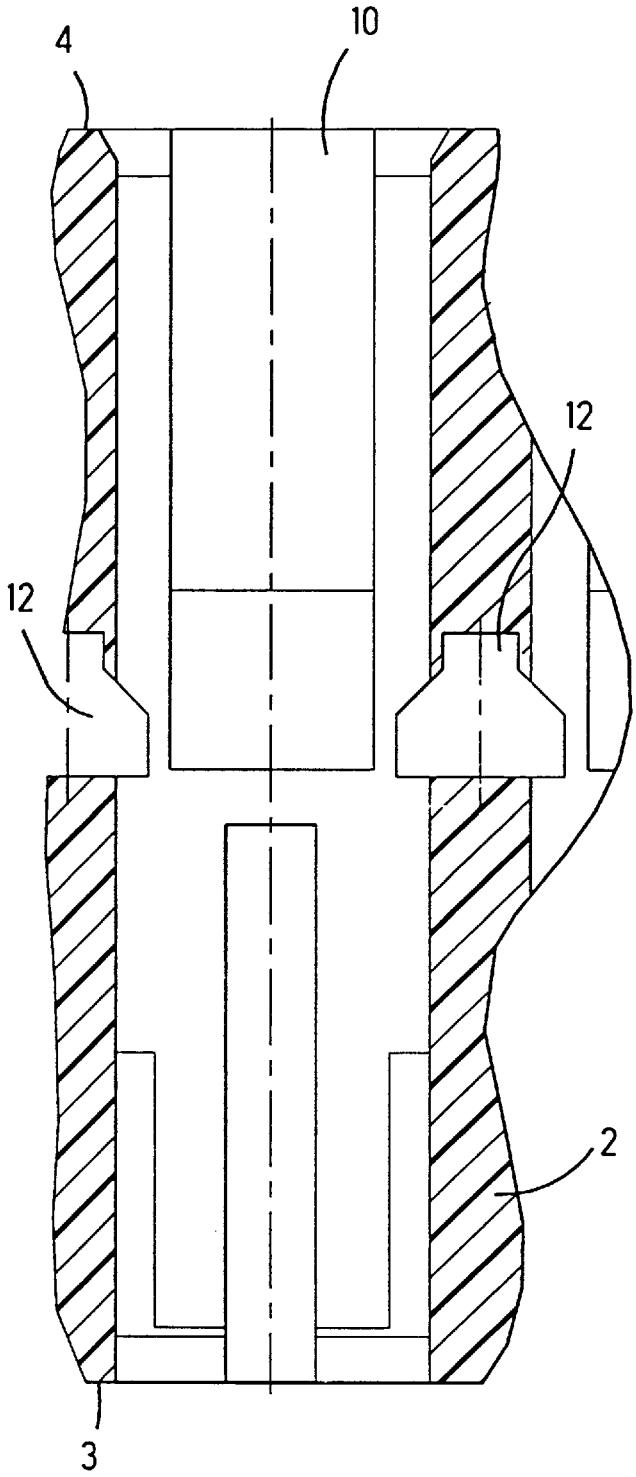
FIG. 13 is a sectional view taken along line XIII—XIII of FIG. 12.
Figure 16:
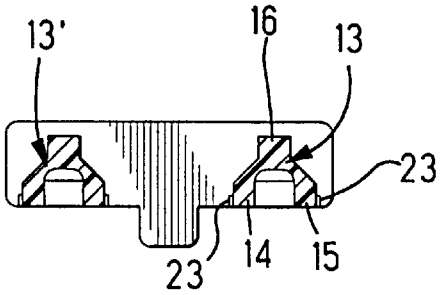
FIG. 16 is a sectional view taken along line XVI—XVI of FIG. 15.

FIG. 1 illustrates an electrical connector 1. The electrical plug connector 1 comprises a housing 2. The housing 2 (see FIGS. 7–11) normally is made from a non-conducting plastic. The housing 2 is of substantially cuboid-shaped design with a front face 3, a cable-side end face 4 and four side walls 5, 6, 7, 8. Located on one side wall 8 of the housing 2 is a latching arm 9. The latching arm 9 serves for latching the electrical connector 1 to a complementary connector. The housing 2 further includes three parallel rows of two parallel chambers 10. The chambers 10 extend from the front face 3 to the cable-side end face 4 and each serves for receiving one electrical contract 11.

The housing 2 further comprises two openings 12 running perpendicular to the chambers 3. Each opening 12 extends from a first side wall 5 to a second side wall 6. Each opening 12 is arranged between two rows of chambers 10 and is in communication with the chambers 10 between which the opening is arranged. The openings 12 are substantially trapezoidal in cross-section, the narrow side of the trapezium facing the cable-side end face 4 of the housing 2. The openings 12 serve for receiving a contact locking element 13, which is a further component of the electrical connector 1. The contact locking element 13 is introduced into the opening 12 from the first side wall 5. The contact locking element 13 serves for securing the contacts 11 in the chambers 10.

The chambers 10 are for receiving one of the an electrical contacts 11. Such an electrical contact 11, which normally is attached to a wire lead (not shown), can be introduced into a chamber 10 from the cable-side end 4 of the housing 2. Such an electrical contact 11 normally comprises a crimping region 24, for fastening an electrical conductor of the lead, that consists of an insulation crimp and a conductor crimp, and also a contacting region 25 for contacting a complementary contact. The contact 11 is introduced into the chamber 10 from the cable-side end face 4 of the housing, contacting region 25 first.

The contacting region 25 of the contact 11 has two locking lances formed as spring tongues 26 arranged on opposite sides. Each chamber 10 includes shoulders 27 formed on opposite walls. When the contact 11 is introduced into the chamber 10, the latching spring tongues 26 will engage the shoulders 27. A first securing of the contact 11 in the chamber 10 thus takes place. If a force to pull the contact 11 out of the chamber is exerted on the cable, the cooperation between the latching spring tongues 26 and the shoulders 27 acts as an obstruction, such that this withdrawal is prevented, at least up to a certain amount of force. In order to prevent the contacts from being pulled out by higher pull-out forces as well, a second securing of the contact 11 is provided, the contact locking element 13, which will now be discussed in detail with reference to FIGS. 14 to 19.

Figure 14:
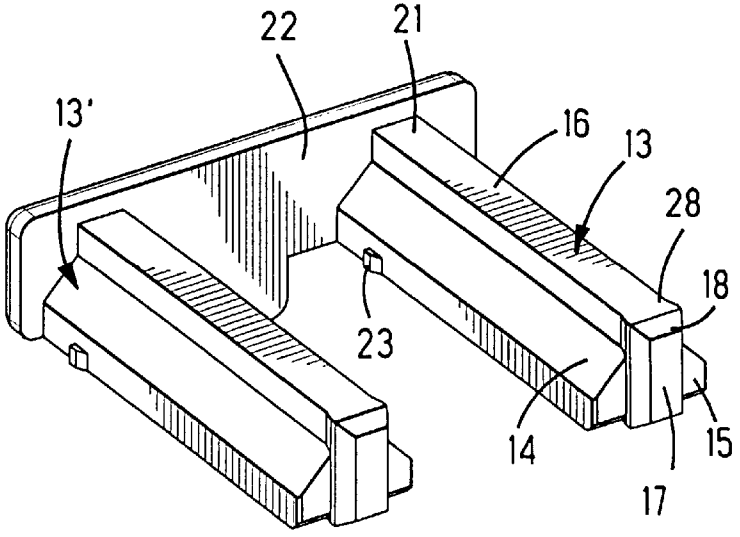
FIG. 14 is a perspective view of two contact locking elements having a common grip for use with the housing of FIG. 7.
Figure 15:
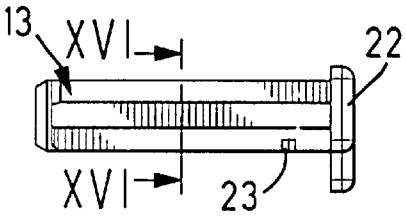
FIG. 15 is a side view of the contact locking element of FIG. 14.
Figure 19:
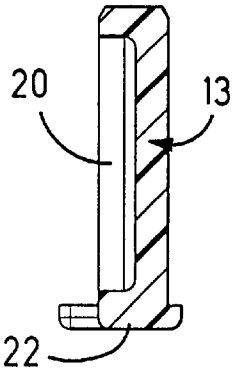
FIG. 19 is a cross-section through one of the locking elements of the contact locking element taken along the line IXX—IXX of FIG. 18.
Figure 17:
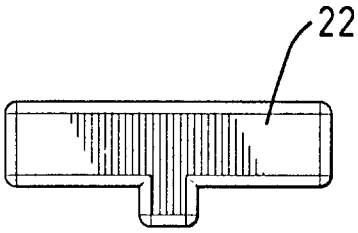
FIG. 17 is an end view of the contact locking element of FIG. 14 taken in the direction of the grip.

FIG. 14 illustrates contact locking element 13. The contact locking element 13 consists of an elongated part with two wall parts 14 and 15 which are each located on a long side of the elongated element. Further, the contact locking element 13 comprises a guide rib 16 located on the upper side of the elongated element. The guide rib 16 connects the two wall parts 14 and 15 to one another. In cross-section, the contact locking element 13 is of substantially V- or U-shaped design. In this arrangement, the wall parts 14 and 15 form the legs of the U, while the guide rib 16 forms the corresponding base. The contact locking element 13 comprises a free lead-in end 17. The free lead-in end 17 is located at one end of the elongated contact locking element 13 and includes there a region 18 tapering towards the free end. The tapering region 18 protrudes with respect to the wall parts 14 and 15 and is joined to the guide rib 16. It simplifies the insertion of the contact locking element 13 into an opening 12.

Figure 18:
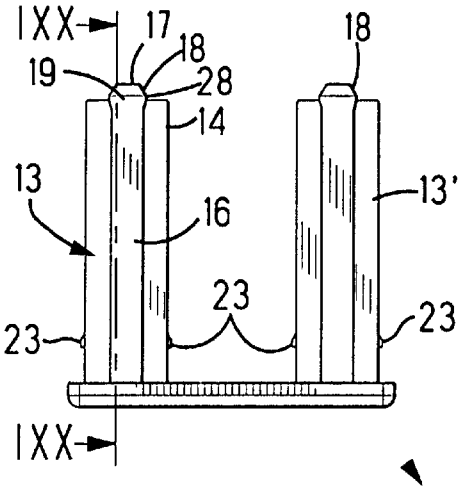
FIG. 18 is a top view of the contact locking element of FIG. 14.

The guide rib 16 also includes a region 19 that protrudes with respect to the wall parts 14, 15 at the lead-in end 17, as best seen in FIG. 18. This protruding region is somewhat widened with respect to the guide rib 16.

This widening 28 at the protruding region 19 produces an interference fit with the opening 12 in the second side wall 6, thereby preventing the contact locking element 13 from being pushed in too far.

Located opposite guide rib 16 and between the wall parts 14 and 15 is a recess 20. The recess 20 enables the wall parts 14 and 15 to be slightly flexible so they can deflect towards one another. The recess 20 does not add to flexibility in the direction perpendicular thereto, that is parallel to the direction of insertion. Owing to this flexibility of the wall regions 14, 15 perpendicular to the direction of insertion, the contact locking element 13 can be easily inserted even into openings having an exact fit therefor.

The contact locking element 13 comprises an actuating element 22 at end 21 that is opposite the free lead-in end 17. The actuating element 22 is designed in the form of a grip which extends substantially perpendicular to the longitudinal axis of the contact locking element 13 to facilitate handling. It is possible to attach a plurality of contact locking elements 13, 13' to a single actuating element 22. The contact locking elements 13, 13' are in this case aligned mutually parallel and are inserted jointly into the housing 2.

The contact locking element 13 has opposite latching tabs 23 on wall parts 14 and 15 in the vicinity of the opposite end 21, to which the actuating element 22 is joined.

These opposite latching tabs 23 serve for latching the contact locking element 13 in the housing 2.

Once contacts 11 have been inserted into the chambers 10 and secured there primarily by means of the latching spring tongues 26 and the shoulders 27, the contact locking element 13 is pushed into a housing 2 through an opening 12 (see FIGS. 1 to 6). If a contact element 11 is not fully inserted, the contact locking element 13 abuts, with a wall part 14, against the contacting region 25 of the electrical contact. As a result of the maximum possible width of the contact locking element 13 relative to the opening 12, as large an overlap as possible occurs between the wall part 14 and the contact 11. The probability of the contact being crushed by the contact locking element is thereby reduced. This is also achieved by the fact that the free ends of the wall parts 14 are not tapered but run perpendicular to the direction of insertion of the contact locking element 13. Only the tapering region 18 arranged on the contact locking element 13 at the lead-in end 17 comprises lead-in tapers, which facilitate the insertion of the contact locking element 13 into the opening 12 and therealong.

If a contact 11 is in the fully inserted position, the contact locking element 13 can be inserted through the opening 12 without obstruction. As a result of the wall parts 14 and 15, respectively, the opposite chambers 10 of two rows are narrowed and the contacts 11 thereby secured in these chambers 10.

In order to latch the contact locking element 13 in the housing 2, latching tabs 23 are attached to the wall parts 14, 15. If a contact locking element 13 is fully inserted, the latching tabs 23 are located in the region within a chamber 10 directly behind the first side wall 5. To remove the contact locking element 13, the latching tabs 23 must again pass through the opening in the side wall 5, which they first strike against. A latching of the contact locking element 13 in the housing 2 that prevent easy removal, is thereby ensured.

We claim:

1. An electrical connector comprising: a housing and a contact locking element, the housing having a front face, a cable-side end face, side walls, and at least two neighbouring chambers for receiving one electrical contact each that extend form the front face to the cable-side end face, the housing further having an opening through a first side wall that extends perpendicular to the neighbouring chambers and between the neighbouring chambers into which the contact locking element can be inserted in order to lock the electrical contacts in their respective neighbouring chambers, the contact locking element formed as a longitudinally extending beam, the beam having at least two longitudinally extending opposite wall parts that extend into and across the neighbouring chambers when the beam is inserted into the opening, wherein the beam has a recess extending between the two wall part, and the two wall parts are connected to one another by way of a guide rib, in such a way that the wall parts are flexible towards the recess.

2. The electrical connector according to claim 1, wherein the contact locking element is of substantially U- or V-shaped design in cross-section, with a pair of generally opposing legs extending from a common base, the legs being formed by the wall parts and the base being formed by the guide rib.

3. The electrical connector according to claim 1, wherein the contact locking element has a free lead-in end and an actuating element at the opposite end and in that the lead-in end comprises a region tapering towards the free end.

4. The electrical connector according to claim 3, wherein the tapering region protrudes with respect to the wall parts and is joined to the guide rib.

5. The electrical connector according to claim 1, wherein the guide rib has a protruding region with respect to the wall parts at the lead-in end, and the protruding region of the guide rib engages in a positive-locking manner in a second side wall of the housing opposite the first side wall.

6. The electrical connector according to claim 1, wherein the contact locking element has a first latching element and in that the housing comprises a latching element complementary thereto, in such a way that the contact locking element is latched in the housing in its end position, in which the contacts are secured in the chambers.

7. The electrical connector according to claim 1, wherein the actuating element is constructed as a grip which extends substantially perpendicular to the direction of insertion of the contact locking element.

8. The electrical connector according to claim 7, wherein the actuating element designed as a grip comprises a plurality of contact locking elements.

* * * * *